US005204595A

United States Patent [19]

Opal et al.

[11] Patent Number: 5,204,595

[45] Date of Patent: Apr. 20, 1993

[54] METHOD AND APPARATUS FOR CONTROLLING A WALKING BEAM PUMP

[75] Inventors: Kenneth E. Opal, Oakmont; William J. Happel, Pittsburgh, both of Pa.

[73] Assignee: Magnetek, Inc., Los Angeles, Calif.

[21] Appl. No.: 664,500

[22] Filed: Mar. 5, 1991

Related U.S. Application Data

[63] Continuation of Ser. No. 297,557, Jan. 17, 1989, abandoned.

[51] Int. Cl.[5] ..... H02P 1/04

[52] U.S. Cl. ..... 318/430

[58] Field of Search ..... 318/282-286, 318/599, 606, 621, 626, 633, 652, 671, 683, 66, 70, 685, 798, 799, 802, 729, 805-812, 430, 432, 434, 438, 439, 474, 521, 529, 536, 537; 388/803, 804, 805

[56] References Cited

U.S. PATENT DOCUMENTS

| | | | |
|---|---|---|---|
| 3,723,840 | 3/1973 | Opal et al. . | |
| 3,735,226 | 5/1973 | Pittner | 318/432 X |
| 3,751,192 | 8/1973 | Boyd | 318/432 X |
| 4,027,215 | 5/1977 | Knight et al. | 318/432 X |
| 4,031,440 | 6/1977 | Christian et al. | 318/432 |
| 4,238,717 | 12/1980 | Knight et al. | 318/432 X |
| 4,293,905 | 10/1981 | Opal . | |
| 4,336,484 | 6/1982 | Marinko | 318/432 X |
| 4,350,944 | 9/1982 | Strauch, Jr. . | |
| 4,417,190 | 11/1983 | Nola | 318/729 |
| 4,534,706 | 8/1985 | Palm et al. | 318/282 |
| 4,578,626 | 3/1986 | Richter | 318/432 X |
| 4,591,781 | 5/1986 | Larson . | |
| 4,646,223 | 2/1987 | Sekiguchi | 318/432 X |
| 4,661,751 | 4/1987 | Werner | 318/474 |
| 4,733,152 | 3/1988 | Allington | 318/605 |

OTHER PUBLICATIONS

Proceedings of the Eighth Annual West Texas Oil Lifting Short Course, Apr. 20-21, 1961.

Computing Gearbox Torque and Motor Loading for Beam Pumping Units With Consideration of Inertial Effects, Journal of Petroleum Technology, Sep., 1975.

Application Bulletin: Solid State Starter Motor Current "Minimizer" Option for Model 439 Solid State Reduced Voltage Starters.

Bulletin 7701: Solid State Motor Starters, Power Control Corporation.

Bulletin 315: Solid State Motor Starters Model 439.

Installation Operation and Maintenance Manual for Solid State Motor Starter Technical Manual TM 5110.

Electronic Products and Services Offered by End Devices, Inc. of Midland, Texas.

Lufkin Mark II Pumping Unit.

FIG. 8-11 Theoretical Dynamometer Representations.

*Primary Examiner*—Jonathan Wysocki

*Attorney, Agent, or Firm*—Krass & Young

[57] ABSTRACT

Method for controlling an electric drive motor coupled to a reciprocating mechanical system such as an oil well walking beam pump by inserting a pair of power-off pulses in a reciprocation period of the pump motor energization cycle, with one pulse in a top-of-cycle region and the other pulse in a bottom-of-cycle region to reduce rod stress and motor electrical power consumption and increase pump displacement and efficiency.

10 Claims, 7 Drawing Sheets

| FIG 5a | FIG 5b |
|---|---|

METHOD AND APPARATUS FOR CONTROLLING A WALKING BEAM PUMP

This is a continuation of co-pending application Ser. No. 07/297,557 filed on Jan. 17, 1989 now abandoned.

BACKGROUND OF THE INVENTION

1. Field of the Invention

The present invention relates to a method for controlling a dynamo-electric machine, more particularly an electric motor, coupled to a reciprocating mechanical system having a large inertia so as to reduce stress in the system and minimize electric power consumption. More particularly, the method of the present invention provides a control system which cycles motor current from a dwell status to a operating torque and current status.

2. Description of the Prior Art

While the present invention is not so limited, it is particularly useful in the control of an electric motor for operating a pump of the type commonly referred to in the art as a walking-beam oil well pump. In the operation of such a pump, a beam rocks back-and-forth about a pivot which is generally but not always located at the center of the beam. One end of the beam is connected to the crank arm of a drive which is, in turn, driven by a motor. The other end of the beam is connected by a pitman tail through a cable to a sucker or polished rod assembly extending to a pump in the bottom portion of an oil well. The instantaneous crank pin and tail bearing locations determine the angle of the pitman and, therefore, the angle along which the force must be applied. The pitman angularity also causes an increase in the force required to balance the load. With the beam horizontal, equal vertical forces at opposite ends of the beam will balance the load on the beam, assuming a centrally located pivot. However, the force applied to the beam by the pump in normal operation changes in a non-linear manner with the position of the beam. Generally, however, as the pitman moves downward, a smaller force is imposed on the beam; as when the pitman moves upward, a larger force is imposed the beam. The mechanical drive system for the beam similarly undergoes cyclically changing non-linear loading which vary with the position of the walking beam. During the up stroke, a plot of load versus displacement shows a rapid increase (i.e., at a relatively steep slope) while the polished rod and column of oil are accelerated upwardly. During the down stroke, the plot of load decreases at a relatively less steep slope as the pump piston moves downwardly under the weight of the rod and oil column. The polished rod, which is also a part of the mechanical system, is typically a series of successively decreasing diameter rods and may undergo an effective length change (strain) due to both static and dynamic loading (stress) on the rod including, for example, a change in direction of the rod s movement in its reciprocating motion as well as the load imposed on the rod by the pumping action. It has been standard practice to observe certain aspects of pumping operation by an analysis using a dynamometer card which shows load versus displacement at the rod. Rod loads may intentionally or unintentionally be dramatically increased by operation at or near resonance of the rod string. In certain applications, such resonance may impose unacceptably high loads on the rod, while in other circumstances, e.g. where static rod loads are greatly below rated loading, such resonant operation can desirably utilized, for example, to reduce electrical power consumption. Since the rod string can be as much as two miles long, and oil viscosity can vary, a great variation may be observed in both the resonant frequency and Q or sensitivity to resonance in pumping systems. If the rod string is long, care must also be taken to avoid driving the pump above the frequency range at which it can respond, since doing so will reduce the stroke volume of the pump which, in turn, will reduce the well output.

It is conventional to use a NEMA Class D motors to drive beam pumps. Since such motors have high slip at rated load, motor speed will drop off appreciably with load increases permitting utilization of stored energy provided by a flywheel which is incorporated into the mechanical system of the beam pump drive. Since the motor provides a large starting torque (up to 275% of full load torque) while requiring a relatively low starting current, Class D motors are well suited for heavy duty applications; however, power consumption by such motors is necessarily larger than NEMA Class B or Class C motors.

SUMMARY OF THE INVENTION

The present invention provides a method and apparatus for providing greater economy and efficiency for operation of a drive motor for a beam pump by not only permitting a reduction in KW power consumption by the drive motor, but also enabling stress reduction in the mechanical drive as well as the polished rod. At the same time, the displacement or stroke of the pump may be increased along with overall pumping efficiency. The control system of the present invention is particularly useful for controlling the operation of a beam pump in a manner such that load versus displacement data of a dynamometer card for a beam pump operating under control of this invention will evidence a reduction of both peak stress and fatigue inducing stress cycling.

According to this invention, there is provided a motor control system wherein motor current is caused to increase and decrease cyclically due to torque output demands imposed on the drive gear by the beam pump. Current is applied to the motor only during a portion of each operating cycle of the pump by ramping-up an applied electrical current to the motor from a free-running condition where the motor is driven by the pump at least by the time the pump is in a pumping mode and reducing the applied electrical current to the motor to allow driving of the motor by the beam pump at least when the beam pump is in a return stroke mode.

In a specific embodiment of the invention, the motor is turned off as the beam and pump piston approaches its extreme upper and lower positions in its reciprocating cycle. Assuming the beam and piston is at its extreme bottom position, current is ramped up rapidly as the piston starts to ascend, while minimizing the stress on the rod and pump mechanism. Current is then either allowed to return to a value demanded by the pump loading or limited to a maximum current limit level until normal pump operation is attained or the beam and piston approaches its extreme uppermost position, whereupon current is again turned off. Current is then either allowed to return to a value demanded by the pump loading or limited to a maximum current limit level until normal pumping operation is attained or the piston approaches its extreme lowermost position, whereupon current is again turned off. Preferably, however, as the beam and piston descend under the force of gravity, current is applied to the motor until the piston approaches its lowermost position, whereupon the cycle is repeated. With this arrangement it is possible to use a cheaper and more efficient NEMA Class C or possibly Class B drive motor for the pump, with the slip required by the pumping system provided by the combination of the motor controller and motor in place of the motor only. The higher efficiency of the NEMA Class C or Class B motor will then improve overall electrical efficiency during the lift and return portions of the cycle.

The above and other objects and features of the invention will become apparent from the following detailed description taken in connection with the accompanying drawings which form a part of this specification and in which:

FIG. 1 is an illustration of a typical oil well pump with which the present invention may be utilized;

Figure 5:
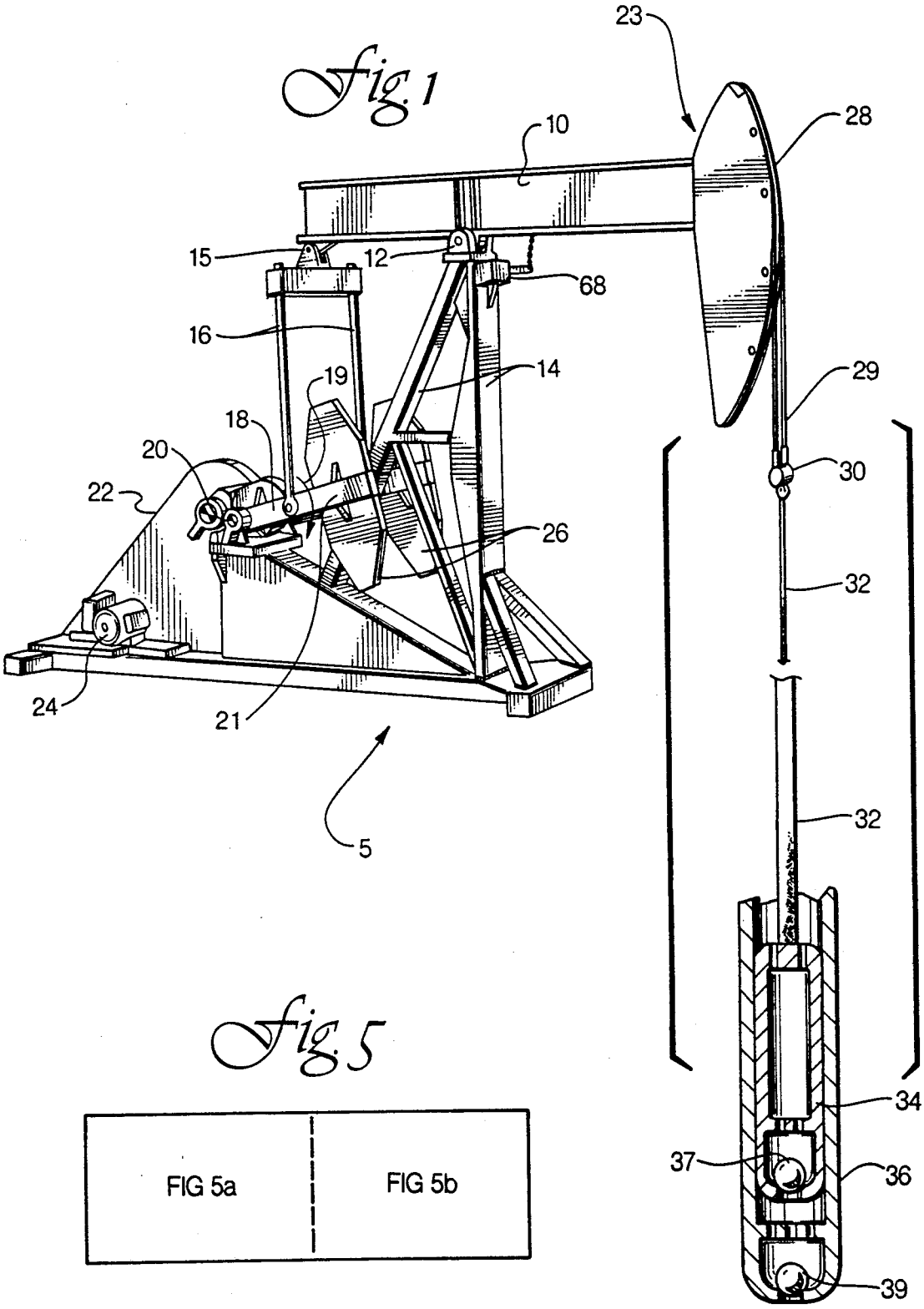
FIG. 5 is a more detailed block diagram of the pump control of FIG. 2.

With reference now to the drawings, and particularly to FIG. 1, a pump system 5 has a walking beam 10 pivotally mounted at 12 to upright supports 14. A link or links 16 pivotally connected between one end 15 of the beam 10 and a crank arm 18 which preferably continuously rotates in direction 19 an inner end 17 of crank arm 18 is mounted on a shaft 20 which, in turn, is connected through a drive system 22 to a drive motor 24. An outer end 21 of the crank arm 18 is preferably provided with counterweights 26 as shown. Another end 23 of the beam 10 is provided with a "horse head" 28 having an arcuate outer face with slots which receive a cable 29 connected at its lower end through a coupling 30 to an oil well sucker rod or polished rod 32.

Polished rod 32 may be several thousand feet long to two miles long or possibly longer, depending upon the depth of the well. It carries a pump piston 34 which reciprocates within the lower end 36 of a well casing. Piston 34 is provided with a check valve 37 which opens on the down stroke of the piston and close on the upward stroke, such that oil will pass through the check valves during the downward stroke and the check valves will close on the upward stroke lifting oil above the piston 34. Casing 36 has a check valve 39 that opens as the piston 34 rises and closes as the piston 34 falls, thereby transferring the oil load between the rod string 32 and the casing 36. It will be appreciated that, typically, when the counterweights 26 are at their lowermost position, "horsehead" 28 will be at its top or uppermost position as will the piston 34.

Figure 3:
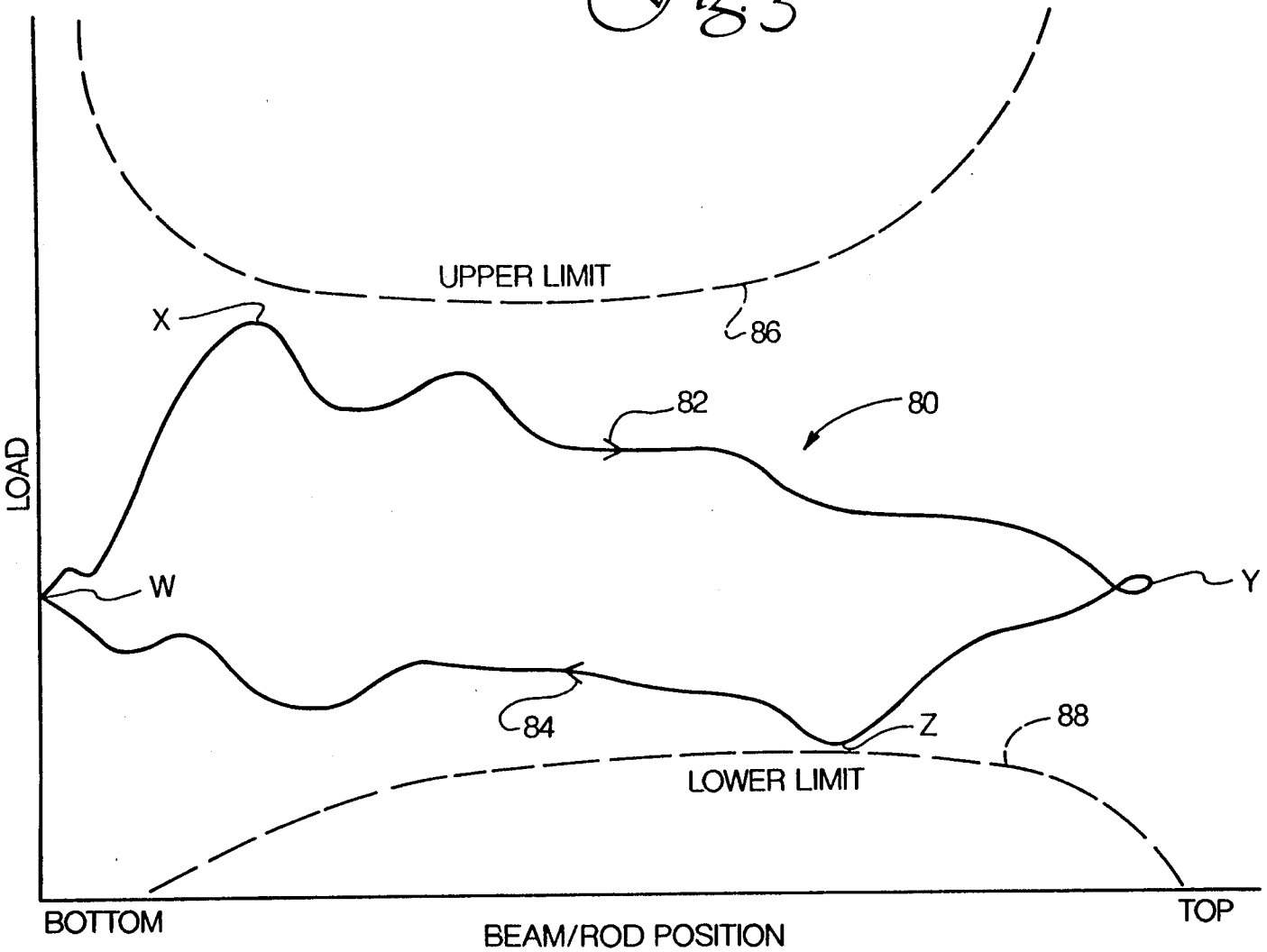
FIG. 3 is an example dynamometer card display of rod versus load displacement.
Figure 4:
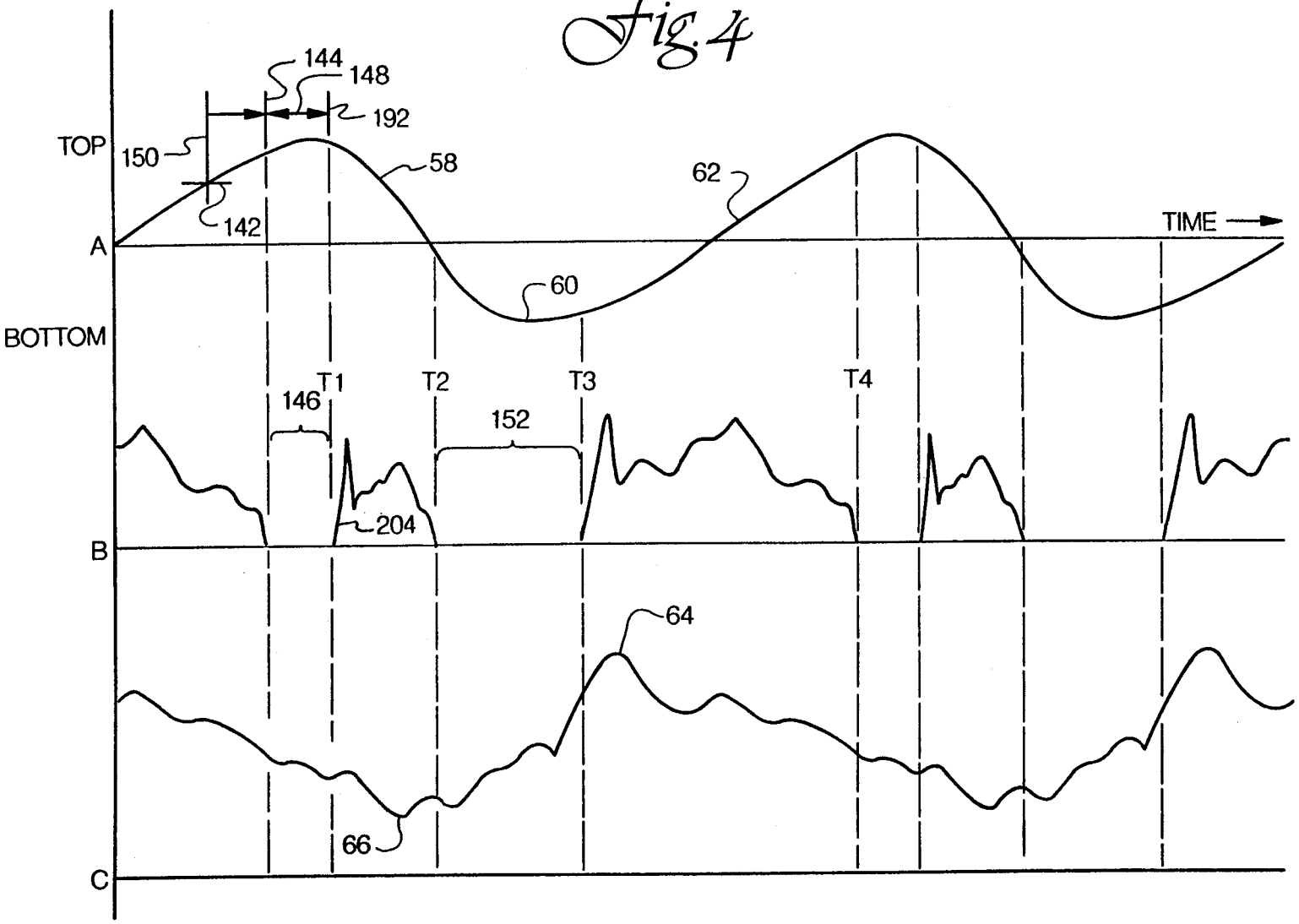
FIG. 4 is a set of waveforms showing rod displacement, motor current and rod load utilizing the method of the invention.
Figure 5A:
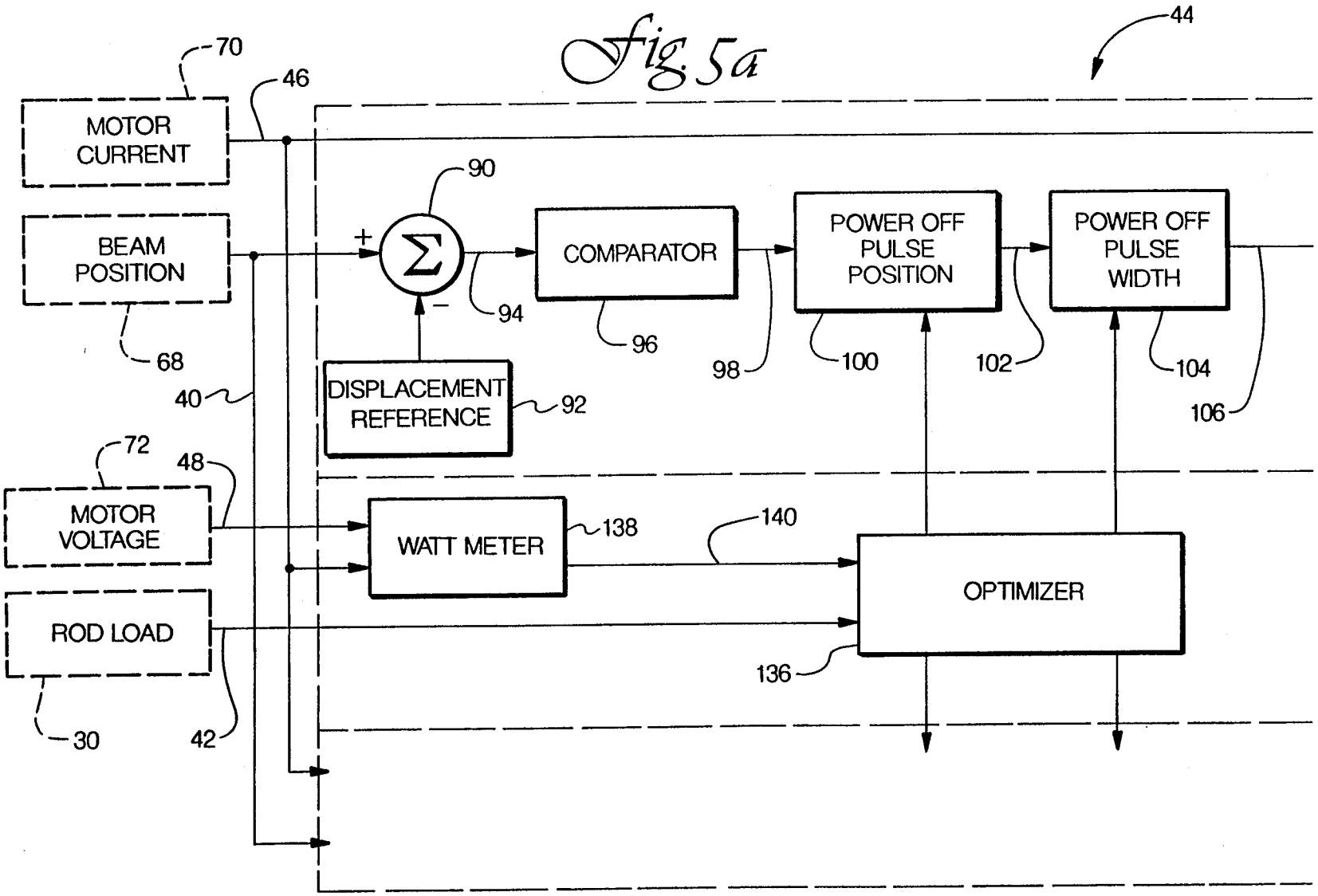
FIGS. 5(A), 5(B) show the pump control.
Figure 5B:
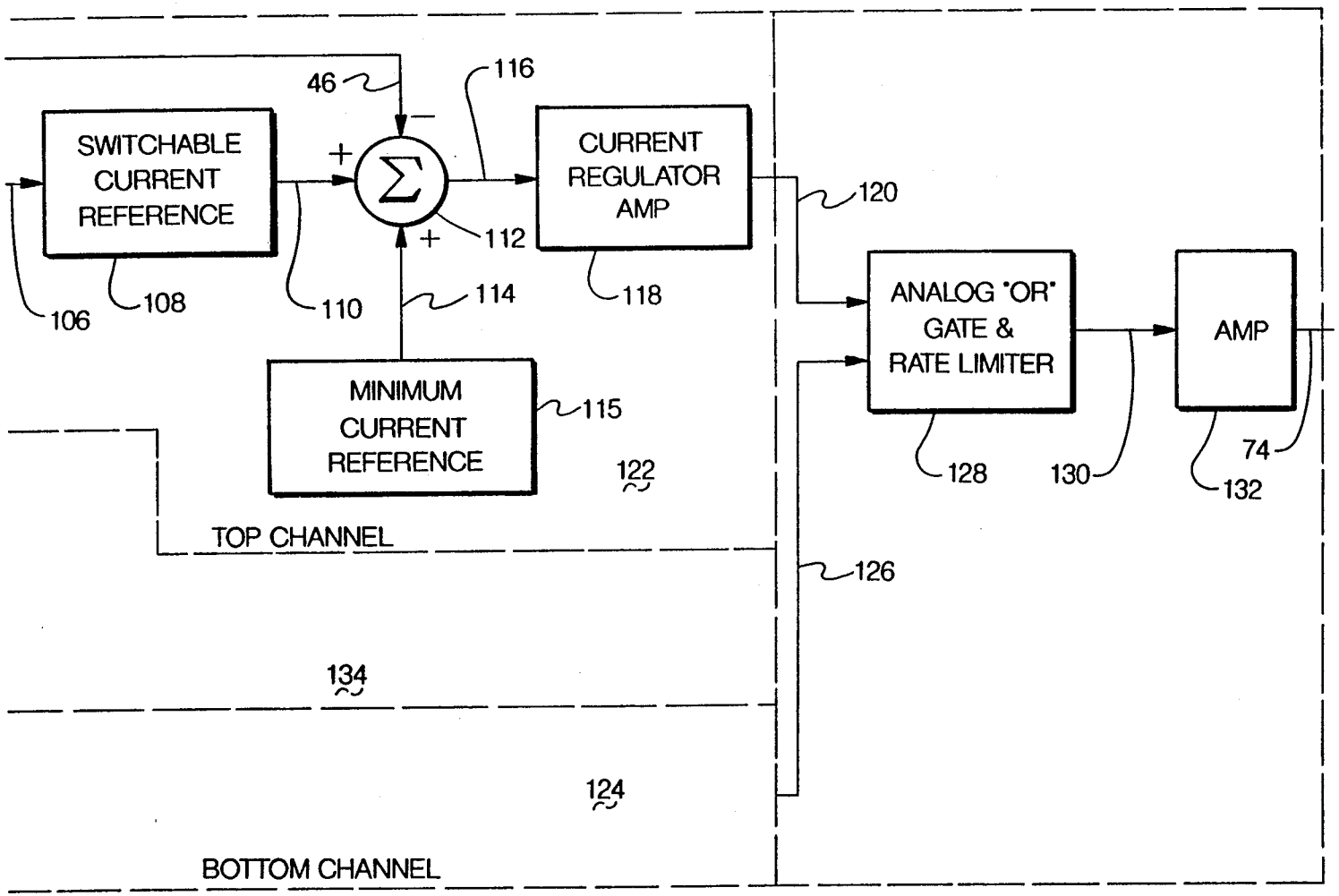

Referring now also to FIG. 4, the piston 34 reciprocates up and down typically in a non-sinusoidal cycle as shown by rod displacement waveform A. The piston moves down between times T1 and T2, for example, at a relatively steep slope. On the other hand, as the piston 34 is pulled upwardly, its displacement from bottom increases between times T3 and T4 at a slower rate or gradual slope 62. If a dynamometer is connected to the drive system for the pump, it will provide a rod load waveform C. It is to be noted that the load on rod 32 is greatest typically at point 64, a short time after lowermost position 60 as the beam 10 and piston 34 accelerate rod string 32 with an oil load upwardly (see waveform C, FIG. 4). Similarly, the load on rod 32 is a minimum at point 66, typically between time T1 and T2, for example, while beam 10 and rod 32 move downwardly and the fluid load is transferred to the casing. Between approximately times T1 and T2, piston 34 is moving downwardly while the load on the drive system remains essentially constant with the counterweight 26 moving upwardly. As piston 34 moves up and down, standing waves can be created that can add or subtract from rod and gear box stress. Shortly after the piston 34 is at its lowermost position 60, high stresses may be imposed on rod 32 as well as the drive system 22 for the beam pump; and these stresses may be amplified by standing waves. In all cases the load must be kept between upper and lower load limits as shown on FIG. 3, to avoid fracture of rod 32 due to fatigue or excess stress, since removal and repair of a fractured lower portion of the rod is very costly. FIG. 4 also shows a motor current waveform B which corresponds to displacement waveform A and rod load C.

Figure 2:
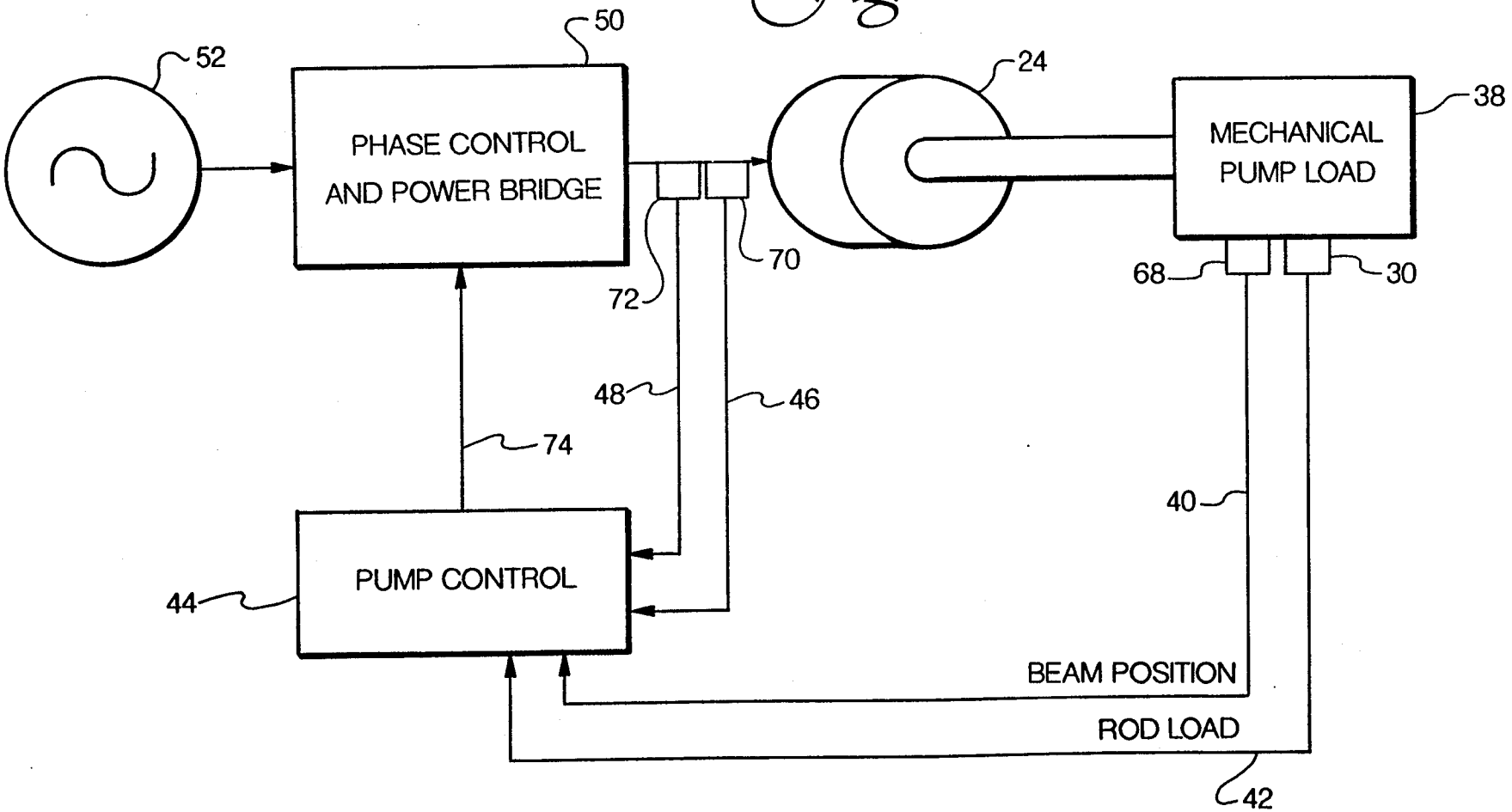
FIG. 2 is an overall schematic diagram of a pump system which may be utilized in practicing of the invention.

In FIG. 2, the drive motor 24 is indicated again by the reference numeral 24 and is connected to a mechanical pump load 38 which includes drive system 22, crank arm 18, counterweights 26, links 16, beam 10, rod 32 and the column of oil above the piston 34. A position transducer 68 provides an electrical signal 40 indicative of the position of beam 10. This signal, for example, can be generated by a potentiometer connected at or near pivot 12 as shown in FIG. 1. Additionally, a load cell may be preferably provided as part of coupling 30 or may be located on the cable 29 or rod 32 to produce an electrical signal 42 proportional to rod load. Alternatively, the load signal 42 can be derived from a strain gauge on the beam 10. Signals 40 and 42 are fed to a pump control circuit 44.

Also fed to pump control 44 are instantaneous motor current and voltage signals 46, 48, supplied by suitable transducers 70, 72, respectively. The output 74 of circuit 44 is applied to a phase control and power bridge 50 connected to an AC power source 52. Preferably, circuit 50 is a solid state motor starter such as a model 439, available from the assignee of the present invention. Output 74 of pump control 44 is connected to a current limit reference input of circuit 50. It is to be understood that transducers 70, 72 may be a part of circuit 50.

Referring now to FIG. 3, a dynamometer card display of polished rod load versus displacement or beam/-rod position may be seen. The reciprocating cycle of the walking beam pump is shown by graph or curve 80, with the leftmost point W corresponding to the bottom of the stroke. Starting at this point, the load will increase up to a peak polished rod load X, traveling in the direction of arrow 82 until the top of stroke Y is attained. At this point, the stroke reverses, and progresses to the minimum polished rod load point Z and continues in the direction of arrow 84 returning to point W at the bottom of the stroke. To provide for safe and reliable operation, the peak polished rod load X (and all other points in the upstroke portion of the load curve) must be below upper limit 86 of rod stress. Similarly, the minimum polished rod load Z (and all other points on the downstroke) must be above lower limit 88 of rod stress.

According to the present invention, a method and apparatus is provided for controlling the drive motor 24 to improve one or more operating parameters of pump system 5, for example, to minimize the stresses in rod 32 and other parts of the pump mechanism. Waveform B in FIG. 4 illustrates the current applied to drive motor 24 in accordance with this method. Between times Tl and T2 when piston 34 moves downwardly and counterweights 26 are moving upwardly, current is ramped up during the initial downward movement of the beam 10 and piston 34 and allowed to assume a normal uncontrolled level or held at a maximum current limit level until normal current is attained or T2 is reached. Between times T2 and T3 the motor 24 is turned off while the beam 10 and piston 34 stops and reverses direction due to the momentum of the system with minimum or no torque being applied by the motor 24. This will minimize stress in the rod 32 during this critical reversal stage. At time T3, current ramps up rapidly as the upward movement of the beam 10 and piston 34 accelerates; the current then decreases to a normal operating level until time T4 when current is again ramped off and the piston 34 "free-wheels" under the momentum of the system, and the cycle is repeated. Due to the dynamics of the system and mechanical design differences, some walking beam pump arrangements will exhibit regeneration at more than one part of the cycle. The control will sense these conditions and turn on and off to free-wheel during these intervals.

Referring now also to FIG. 4 again, pump control 44 controls motor current in accordance with waveform B in response to beam position and load and motor voltage and current to improve one or more of the pump operation parameters of electrical power consumption, or rod stress. Power-off pulses for motor current can be determined empirically from actual well conditions and will depend, for example, on the depth of the well, the weight of the oil column and other factors. The pump control 44 can be replaced by a microprocessor, the programming of which is well within the skill of the art. Referring now also to FIG. 5, a more detailed block diagram of pump control 44 may be seen.

Referring now more particularly to FIG. 5, the beam position signal 40 from the position transducer 68 is summed at a summing junction 90 with a displacement reference signal 92. The resultant signal 94 is supplied to a comparator 96. Comparator 96 provides a trigger input 98 to a power-off pulse position block 100. Block 100 preferably provides pulse output 102 indicative of the position for the power-off pulse in the reciprocating cycle of the pump. Output 102 is coupled to a power-off pulse width block 104 which provides an adjustable width pulse signal 106. Signal 106 is connected to a switchable current reference 108 providing a switchable current reference signal 110 to summing junction 112, along with a minimum current reference signal 114 from block 115 and the motor current feedback signal 46. The current error signal 116 is provided to a current regulator amplifier 118 having an output 120.

It is to be understood that the signal path from summing junction 90 through current regulator amplifier 118 makes up the elements of top channel block 122. Preferably, bottom channel block 124 is made up of a similar set of elements. Output 126 of the bottom channel block and output 120 of the top channel block are fed to an analog OR gate and rate limiter 128. Output 130 from limiter 128 is fed to a buffer amplifier 132 which provides signal 74 to circuit 50.

A supervisory control section 134 may be provided as part of pump control 44. Section 134 may be embodied as part of a microcomputer control system, or alternatively, the functions of portion or section 134 may be accomplished manually to achieve the goals for whichever mode pump control 44 is operating in. A still further alternative is to utilize a control strategy disclosed in U.S. Pat. No. 3,723,840, which is hereby incorporated by reference, for the function of optimizer circuit 136. The function of circuit 136 is to observe the desired operating parameter or parameters and adjust the power-off pulse position and width to improve the observed operating parameter. For example, if electrical power consumption is to be minimized, a conventional watt meter circuit 138 may be utilized to provide an appropriate output 140 which is observed by optimizer 136. Incremental changes are made in the power-off pulse position and width and the watt meter output 140 is observed to determine whether power consumption has increased or decreased. If consumption has decreased, further changes to the power-off pulse position and width are made in the same direction. If power consumption has increased, optimizer 136 will adjust the power-off pulse position and width in the opposite direction to determine whether power consumption evidenced by output 140, has decreased. When output 140 stops changing, optimizer 136 will determine that electrical power consumption cannot further be reduced. It is to be understood that optimizer 136 will operate on both the top channel 122 and the bottom channel 124.

The logic circuitry of pump control 44 operates to regulate and ramp motor current ON and OFF in response to sensed parameters via various selected control modes. Selection of the specific control mode is based upon actual field conditions and the desired results.

Mode I minimizes or improves electrical power consumption (i.e., less KW/barrel of fluid). Control is accomplished by the previously described ON/OFF current ramping to vary pulse position and duty cycle such as to minimize motor KW while increasing the ratio of strokes per minute to KW (SPM/KW).

Mode II may be used to reduce peak polished rod load to minimize elongation of rod 32. Mode II also results in reduced torque loads at drive system 22. Control is accomplished using the same ON/OFF control as in Mode I except such as to minimize peak rod stress to reduce rod elongation while maintaining ±20% strokes per minute. Alternatively, incremental rod stress may be minimized by minimizing peak polished rod load while increasing minimum polished rod load.

Mode III may be used to improve pump efficiency (i.e., to increase the ratio of pump output to power input. This may be accomplished by increasing displacement). It may be noted that efficiency may be improved by reducing electrical power input, as is achieved in Mode I.

Mode IV may be used to improve overall performance by a balance of the above three modes (i.e., reducing electrical power consumption, reducing rod/gear box stress, and improving pump efficiency). This mode is again accomplished using the ON/OFF control of Mode I except in such a manner to reduce peak rod stress and average electrical power consumption while simultaneously maintaining or increasing pump efficiency and holding strokes per minute constant to within ±5%.

Mode V may be used to maintain positive rod stress. This mode operates with any of the above, except it also uses the rod load signal 42 to adjust motor torque in such a manner as to always maintain a positive stress on the rod string 32. This operation is particularly beneficial for deviated wells which have floating rods due to the degree of deviation and/or high oil viscosity. This mode functions the same as the above, except that during the downward stroke of the rod, the motor current is regulated to assure a positive preset minimum load on the rods while maintaining continuous operation.

Referring now to both FIGS. 4 and 5, the operation of pump control 44 is as follows. A reference level 142 is preferably set by a potentiometer acting as displacement reference 92. When waveform A crosses threshold or level 142 set by the displacement reference 92, comparator 96 will trip, triggering a monostable multivibrator or other pulse forming means 100 which, preferably, will generate a variable width pulse to set or determine the position of leading edge 144 of the power-off pulse 146. Signal 102 will preferably activate a second one shot 104 which will set width 148 of the top channel power-off pulse 146. This arrangement has been found desirable to give independent adjustment of the position and width of the power-off pulse 146 and to trigger the starting point 150 on a relatively steep slope such as 62 rather than a shallow slope which exists at the top of the stroke and which would be more susceptible to error due to noise on waveform A. Each of functions 100 and 104 may be performed by hardware, in a conventional manner, as for example utilizing 555-type timers, or may be practiced utilizing software timers such as are conventionally available in, e.g., a 68HCll microcontroller, available from Motorola.

Power-off pulse 152 for the bottom of stroke is similarly provided by bottom channel 124.

Figure 6:
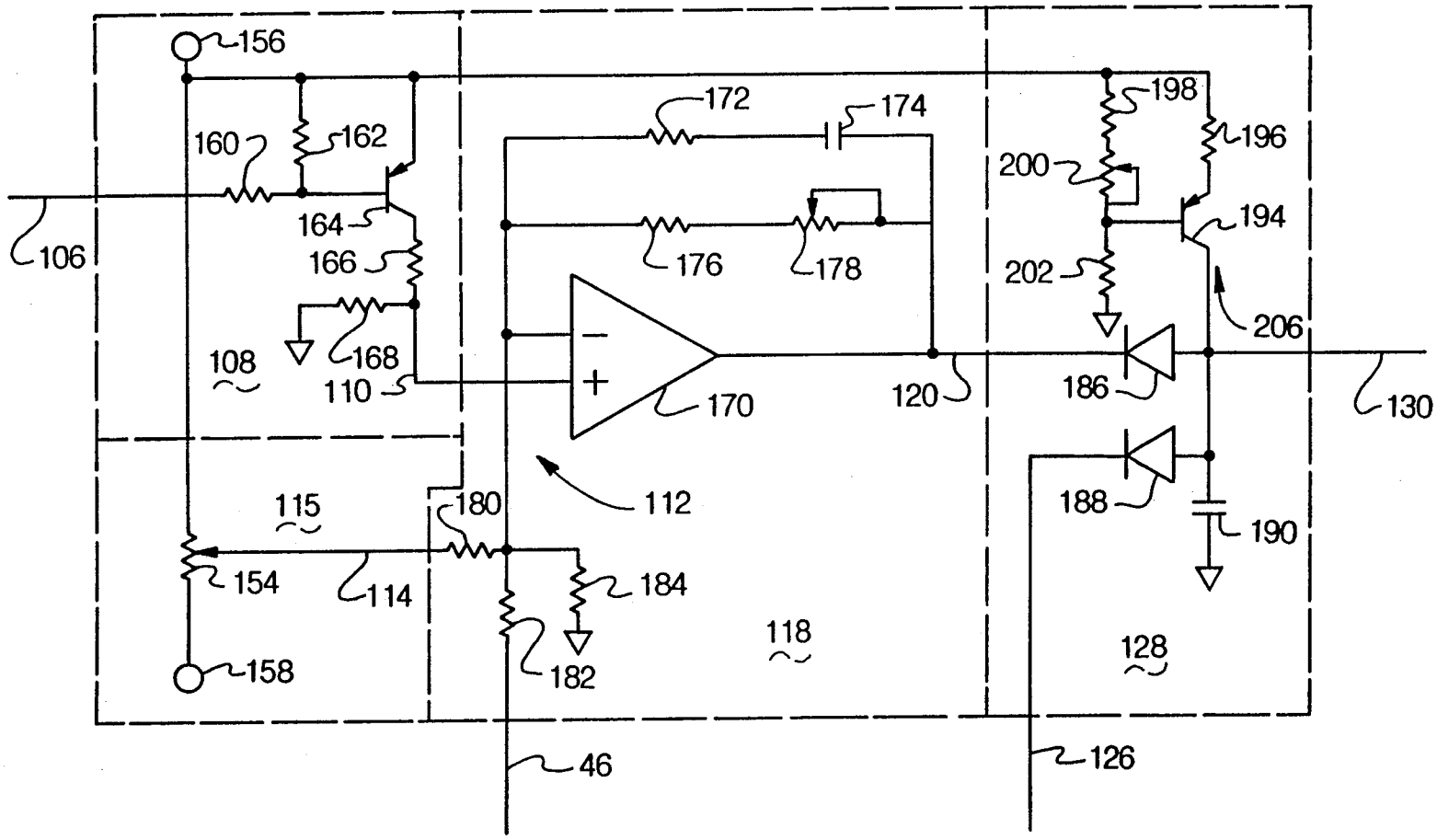
FIG. 6 is a detailed electrical schematic of a portion of the pump control of FIG. 5.

Referring now more particularly to FIG. 6, a detailed electrical schematic may be seen for the switchable current reference 108, the minimum current reference 115, current regulator 118, and analog OR gate and rate limiter 128. Minimum current reference 115 is preferably, in this embodiment, a 5K potentiometer 154 connected between the positive power supply 156 and the negative supply 158, which are, preferably, at + and − 15 volts, respectively.

Switchable current reference 108 preferably is made up of two 10K resistors 160, 162 and a PNP switching transistor 164. Transistor 164 feeds a 1K summing resistor 166; a 10K resistor 168 is connected from resistor 166 to circuit common. It is to be understood that minimum current reference 115 and switchable current reference 108 may be practiced in software, for example with a 68HCll microcontroller, in which case minimum current reference 115 would represent a numerical value for the lowest level of current in a current control algorithm, and switchable current reference 108 would represent a numerical value switched on and off by the software.

Returning to the hardware embodiment of FIG. 6, amplifier 118 is preferably a proportional plus integral circuit utilizing a conventional operational amplifier 170 having a 15K resistor 172 connected in series with a 0.33 uF capacitor 174. A 10K resistor 176 is preferably connected in series with a 100K potentiometer 178 to provide the proportional feedback. Circuit 118 further has three 10K resistors 180, 182, 184 making up an input network.

Referring now to analog OR gate and rate limiter 128, a pair of diodes 186, 188 are connected respectively to the outputs 120, 126 of top and bottom panels 122, 124. Normally, when channel 122 is active, signal 126 will be at a relatively high level and be blocked by diode 188. When a power-off pulse occurs, signal 120 is pulled closed to circuit common, discharging a 1 uF capacitor 190 and holding signal 130 at circuit common. This, in effect, is a zero command or reference for the current limit of circuit 50, and removes excitation from the motor 24 as shown at 146, 152 in FIG. 4.

Once the power-off pulse is completed (as at 192 on waveform A of FIG. 4) switchable current reference 108 is commanded on by signal 106, causing signal 120 to assume a high level. Capacitor 190 will then be charged by a current source made up of a PNP transistor 194, a 6.8K resistor 196, a 470 ohm resistor 198, a 3.5K potentiometer 200, and a 10K resistor 202. This will have the effect of limiting the rate of rise of the current in the motor, as shown at slope 204 in waveform B of FIG. 4. Thereafter, current will follow the signal 120, offset by the drop of diode 186, and limited in the positive going direction by the charging rate of capacitor 190 and current source 206.

It is to be understood that the function of block 128 may similarly be carried out in software utilizing conventional programming techniques.

Amplifier 132 (see FIG. 5) is preferably a unity gain non-inverting follower.

It is to be further understood that the controller may also provide the function of soft starting and stopping of the beam pump in response to a pump off controller as commonly used in the industry. This soft start/stop action further reduces mechanical and electrical transients on the system therefore reducing maintenance costs and extending equipment life.

The invention is not to be taken as limited to all of the details thereof as modifications and variations thereof may be made without departing from the spirit or scope of the invention.

What is claimed is:

1. In a walking beam pump system having an electrical motor coupled through a drive system to pumping apparatus which includes reciprocating pump means operated by a walking beam mounted for cyclical rocking movement, the apparatus including an inertial mass tending to maintain the rocking movement, the method of controlling the pump system comprising the steps of:

driving the walking beam by the motor during part of the rocking cycle to provide pumping effort;

turning off the motor when the walking beam approaches the upper limit of its rocking cycle and holding the motor off until the rocking cycle is in a downward movement, and turning off the motor when the walking beam approaches the lower limit of its rocking cycle and holding the motor off until the rocking cycle is in an upward movement;

wherein inertial movement of the pumping apparatus continues the rocking cycle and the motor is driven by the pumping apparatus when it is turned off.

2. The invention as defined in claim 1 including the steps of:

sensing the position of the rocking beam;

sensing motor power;

for each said portion, determining from the power and the beam position the optimum time to turn off the motor and the optimum motor off period to conserve electrical energy while maintaining effective pump operation.

3. The invention as defined in claim 1 including the steps of:

sensing the position of the rocking beam;

sensing stress in the pumping apparatus;

for each said portion, determining from the stress and the beam position the optimum time to turn off the motor and the optimum motor off period to maintain said stress within preset bounds or reduce incremental stress while maintaining effective pump operation, thereby extending the life of parts subject to failure due to stress.

4. The invention as defined in claim 1 including the step of:

turning the motor on gradually after each said portion by initially increasing the motor current in a ramp fashion to minimize stress in the pumping apparatus due to motor turn on.

5. The invention as defined in claim 1 wherein the reciprocating pump means comprises a pumping piston and a polished rod operatively connected between the piston and the walking beam, and wherein the method includes the steps of:

measuring the stress in the polished rod; and determining in response to the measured stress when in the rocking cycle and for how long to turn off the motor to reduce stress in the polished rod.

6. The invention as defined in claim 5 including the step of:

controlling the motor torque in response to the said measured stress to maintain the polished rod in tension throughout the rocking cycle.

7. A walking beam pump system including:

a walking beam mounted for cyclical rocking movement;

an electrical motor having on and off periods during the rocking cycle for driving the walking beam during on periods;

driving apparatus for coupling the motor to the walking beam, the driving apparatus having an inertial mass for maintaining rocking movement and driving the motor during motor off periods;

means for sensing the operating parameters of the pump system; and motor control means responsive to the operating parameters for establishing the motor on and off periods for improved operation compared to full time motor driving including a first circuit for determining a first off period beginning as the walking beam approaches the upper limit of the rocking cycle, and a second circuit for determining a second off period beginning when the walking beam approaches the lower limit of the rocking cycle, each circuit being effective to turn off the motor for the duration of the respective off period.

8. The invention as defined in claim 7 wherein the sensed operating parameters are walking beam position and motor power and the motor control means includes means for establishing the time and duration of motor off periods in each cycle to minimize electrical energy usage while maintaining a desired pumping rate.

9. The invention as defined in claim 7 wherein the sensed operating parameters are stress in the system and walking beam position and the motor control means includes means for establishing the time and duration of motor off periods in each cycle to minimize incremental system stress or maintain system stress within desired limits while maintaining a desired pumping rate.

10. The invention as defined in claim 7 including a third circuit responsive to system operating parameters and coupled to the first and second circuits for determining the optimum beginning and the duration of each off period to optimize selected ones of the said parameters.

* * * * *